US011136739B2

(12) United States Patent
Pang

(10) Patent No.: US 11,136,739 B2
(45) Date of Patent: Oct. 5, 2021

(54) MODULAR BUILDING FOR CIVIL USE

(71) Applicant: Zhong Pang, Xingtai (CN)

(72) Inventor: Piao Pang, Xingtai (CN)

(73) Assignee: Zhong Pang, Xingtai (CN)

( * ) Notice: Subject to any disclaimer, the term of this patent is extended or adjusted under 35 U.S.C. 154(b) by 0 days.

(21) Appl. No.: 16/754,730

(22) PCT Filed: Sep. 29, 2018

(86) PCT No.: PCT/CN2018/108722

§ 371 (c)(1),
(2) Date: Apr. 8, 2020

(87) PCT Pub. No.: WO2019/072119

PCT Pub. Date: Apr. 18, 2019

(65) Prior Publication Data

US 2020/0308798 A1 Oct. 1, 2020

(30) Foreign Application Priority Data

Oct. 11, 2017 (CN) ..... 201721302493.X

(51) Int. Cl.

| | |
|---|---|
| ***E02D 27/01*** | (2006.01) |
| ***E04B 1/21*** | (2006.01) |
| ***E04B 1/38*** | (2006.01) |
| ***E04B 5/02*** | (2006.01) |

(52) U.S. Cl.

CPC ..... *E02D 27/01* (2013.01); *E04B 1/21* (2013.01); *E04B 1/38* (2013.01); *E04B 5/02* (2013.01)

(58) Field of Classification Search

CPC ..... E04B 1/98; E04B 1/21; E04B 1/38; E02D 27/01

See application file for complete search history.

(56) References Cited

U.S. PATENT DOCUMENTS 1,834,892 A * 12/1931 Paulbetzler ..... E04B 1/04 52/284
4,565,043 A * 1/1986 Mazzarese ..... E04B 2/26 52/592.6
4,653,239 A * 3/1987 Randa ..... E04B 1/35 52/220.2
4,860,505 A * 8/1989 Bender ..... E02D 29/025 405/286

(Continued)

FOREIGN PATENT DOCUMENTS

CN 204163095 U 2/2015
CN 106065666 A 11/2016

(Continued)

*Primary Examiner* — Paola Agudelo
(74) *Attorney, Agent, or Firm* — Slater Matsil, LLP

(57) ABSTRACT

The present disclosure discloses a modular building for civil use, which comprises a wall panel (6), a floor panel (5), a vertical column, and a foundation block (1). A protrusion (11) is provided at a center of a bottom surface of the foundation block (1), and a recess (12) is provided at a center of a top surface of the foundation block (1). A protruding post matched with the recess (12) of the foundation block (1) is provided at a bottom part of the vertical column. An engagement structure for connecting with the wall panel (6) and/or the floor panel (5) is provided on the vertical columns.

3 Claims, 6 Drawing Sheets

(56) References Cited

U.S. PATENT DOCUMENTS

| | | | | | |
|---|---|---|---|---|---|
| 5,493,838 | A * | 2/1996 | Ross | E02D 29/05 | 405/229 |
| 5,505,034 | A * | 4/1996 | Dueck | E02D 29/025 | 405/286 |
| 5,727,358 | A * | 3/1998 | Hayashi | E04B 1/21 | 52/745.2 |
| 6,082,933 | A * | 7/2000 | Maguire | E02D 29/025 | 405/286 |
| 6,871,468 | B2 * | 3/2005 | Whitson | E02D 29/025 | 52/169.4 |
| 7,185,470 | B1 * | 3/2007 | Link | E04C 1/395 | 405/284 |
| D724,760 | S * | 3/2015 | Saunders | D25/113 | |
| 2002/0170245 | A1 * | 11/2002 | Mo | E04B 1/21 | 52/167.1 |
| 2009/0165399 | A1 * | 7/2009 | Gines | E04B 1/04 | 52/79.1 |
| 2011/0225905 | A1 | 9/2011 | Kusuma | | |
| 2013/0061553 | A1 * | 3/2013 | Nagy | E04B 1/483 | 52/741.3 |

FOREIGN PATENT DOCUMENTS

| | | | |
|---|---|---|---|
| CN | 106703201 | A | 5/2017 |
| CN | 107435375 | A | 12/2017 |
| GB | 2188079 | A | 9/1987 |

* cited by examiner

MODULAR BUILDING FOR CIVIL USE

CROSS-REFERENCE TO RELATED APPLICATIONS

This application is a national stage application of International Application No. PCT/CN2018/108722, filed on Sep. 29, 2018, which claims priority to Chinese Patent Application No. CN201721302493.X, filed on Oct. 11, 2017. The disclosures of the aforementioned applications are hereby incorporated herein by reference in their entireties.

TECHNICAL FIELD

The present disclosure relates to the building field, and in particular to a modular building for civil use.

BACKGROUND

Along with the economic development of our country and the acceleration of rural urbanization, rural buildings are more and more popular. In the prior art, the building structure is mainly divided into a brick wall structure and a reinforced concrete structure, but the two building structures have some problems as follows: 1. the building construction process is complicated, and many kinds of auxiliary materials are needed, and many materials are wasted, and the construction period is long; 2. the building materials cannot be reused, and the building waste causes environment pollution when the building is removed; 3. the building is fixed rather than movable. The patent whose patent number is ZL2017210119726 discloses an assemble movable building, which is suitable for a large-span building, and has advantages such as safe and reliable structure, energy-saving and environment protection, low cost, assembly quickly and strong weight-bearing, and the building is an integrated movable building assembled by prefabricated reinforced concrete components. However, many rural buildings are 2-3 layers of buildings with small spans, the movable buildings that can be assembled by this patent are used as a building mode, resulting in complicated structure, troublesome assembly, and long work period.

SUMMARY

These and other problems are generally solved or circumvented, and technical advantages are generally achieved, by embodiments of the present disclosure which provide modular building for civil use.

The object of the present disclosure is to provide an integrated modular building for civil use assembled by prefabricated reinforced concrete components, which is simple in structure and quick to assemble.

The technical solution of the present disclosure is as follows: a modular building for civil use comprises a wall panel, a floor panel and a vertical column, wherein the movable building further comprises a foundation block, a protrusion is provided at a center of a bottom surface of the foundation block, and a recess is provided at a center of a top surface of the foundation block, and a protruding post matched with the recess of the foundation block is provided at a bottom part of the vertical column, and an engagement structure for connecting with the wall panel and/or the floor panel is provided on the vertical column.

As an improvement of the present disclosure, the vertical column is selected from a group consisting of a right-angle vertical column, a T-shaped vertical column, and a cross-shaped vertical column.

As an improvement of the present disclosure, the wall panel comprises an outer wall panel and an inner wall panel.

As an improvement of the present disclosure, a main body of the right-angle vertical column is a right-angle vertical plate, and the engagement structure of the right-angle vertical column is as follows: ends of two right-angle plates of the right-angle vertical plate are provided with a plurality of hanging lugs for connecting with the outer wall plate, and an arc-shaped overlap groove for overlapping with the floor panel is provided between the two right-angle plates; the T-shaped vertical column comprises a T-shaped vertical plate, a plurality of hanging lugs for connecting with the outer wall panel are provided at ends of two transverse plates of the T-shaped vertical plate, and a plurality of hanging lugs for connecting with the inner wall panel are provided at an end of a vertical plate perpendicular to one of the transverse plates of the T-shaped vertical plate, and arc-shaped overlap grooves for overlapping with the floor panel are arranged between the T-shaped vertical plates; the cross-shaped vertical column comprises a cross-shaped vertical plate, and a plurality of hanging lugs for connecting with the inner wall panel are disposed at ends of four plates of the cross-shaped vertical plate, and arc-shaped overlap grooves for overlapping with the floor panel are disposed between adjacent cross-shaped vertical plates.

As an improvement of the present disclosure, four corners of the wall panel are provided with hanging posts matched with the hanging lugs, and four edges of the wall panel are provided with strip-shaped grooves or strip-shaped protrusions for connecting adjacent wall panels, and the four corners of the floor panel are provided with arc-shaped protrusions matched with the arc-shaped overlap grooves on the vertical column, and four edges of the floor panel are provided with strip-shaped grooves or strip-shaped protrusions for connecting adjacent floor panels.

As an improvement of the present disclosure, cement is poured into gaps at joints between the vertical column and the wall panel and between the vertical column and the floor pane.

The present disclosure is mainly applied to a modular building for civil use with a small span, which is an integrated movable building made from reinforced concrete. Foundation blocks, the wall panels, floor panels and vertical columns are prefabricated in a factory with reinforced cement according to a size of a desired building. The number of hanging lugs and arc-shaped overlap grooves of the vertical columns coincides with the number of layers of the desired building, that is to say, if planning to build two floors, the vertical columns are made to contain two hanging lugs in each plate and two arc-shaped overlap grooves when pouring. An area size of the floor panel is matched with an area size of the desired building. Components such as the foundation blocks, the vertical columns, the floor panels, and the wall panels of the present disclosure are integrally cast and formed in one step, and the weight-bearing and connection frame strength thereof are high. The prefabricated components of the building are poured in the factory, and then transferred to a building site, and the components are inserted and connected, and then cement is poured into gaps at joints thereof to complete construction. In this way, construction of the building is simple and quick, time-saving and work-saving and good stability, and the assembled integral integrated building made from reinforced concrete can be dismounted at any time according to the requirement of the building, and transported to a new place, and remounted together to build a new integrated building made from reinforced concrete. 90% of the construction work for the building can be completed in the factory, thereby enabling fast on-site assembly, rapid transport, and safe and reliable operation.

The foregoing has outlined rather broadly the features and technical advantages of the present disclosure in order that the detailed description of the disclosure that follows may be better understood. Additional features and advantages of the disclosure will be described hereinafter which form the subject of the claims of the disclosure. It should be appreciated by those skilled in the art that the conception and specific embodiment disclosed may be readily utilized as a basis for modifying or designing other structures or processes for carrying out the same purposes of the present disclosure. It should also be realized by those skilled in the art that such equivalent constructions do not depart from the spirit and scope of the disclosure as set forth in the appended claims.

BRIEF DESCRIPTION OF THE DRAWINGS

For a more complete understanding of the present disclosure, and the advantages thereof, reference is now made to the following descriptions taken in conjunction with the accompanying drawings, in which.

Corresponding numerals and symbols in the different figures generally refer to corresponding parts unless otherwise indicated. The figures are drawn to clearly illustrate the relevant aspects of the various embodiments and are not necessarily drawn to scale.

DETAILED DESCRIPTION OF ILLUSTRATIVE EMBODIMENTS

The making and using of the embodiments of this disclosure are discussed in detail below. It should be appreciated, however, that the concepts disclosed herein can be embodied in a wide variety of specific contexts. The specific embodiments discussed are merely illustrative, and do not limit the scope of the claims.

Figure 1:
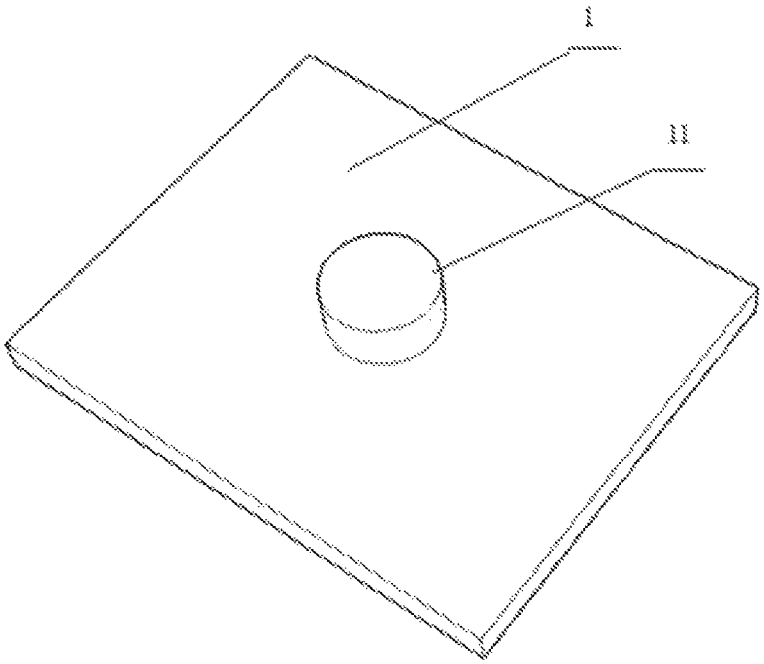
FIG. 1 is a bottom view structural schematic diagram of a foundation block of a modular building according to one embodiment of the present disclosure.
Figure 2:
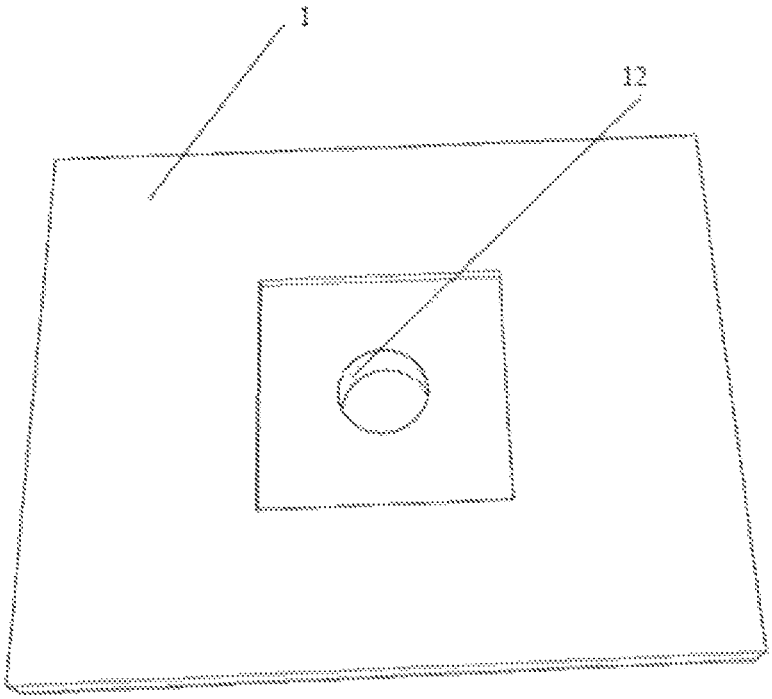
FIG. 2 is a top view structural schematic diagram of a foundation block of the modular building according to one embodiment of the present disclosure.
Figure 3:
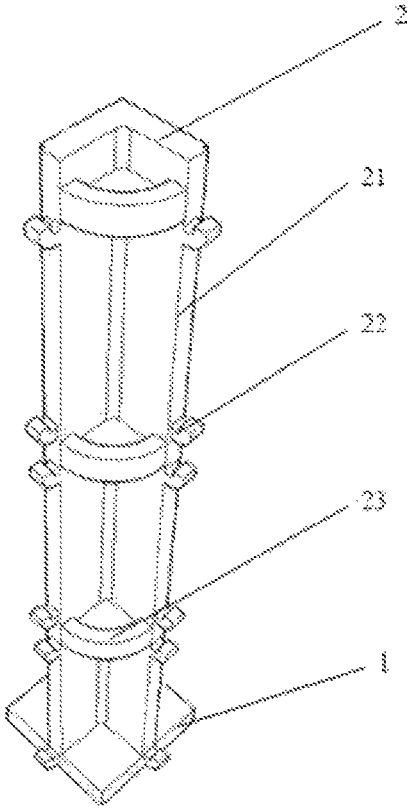
FIG. 3 is a structural schematic diagram of a right-angle vertical column of the modular building according to one embodiment of the present disclosure.
Figure 4:
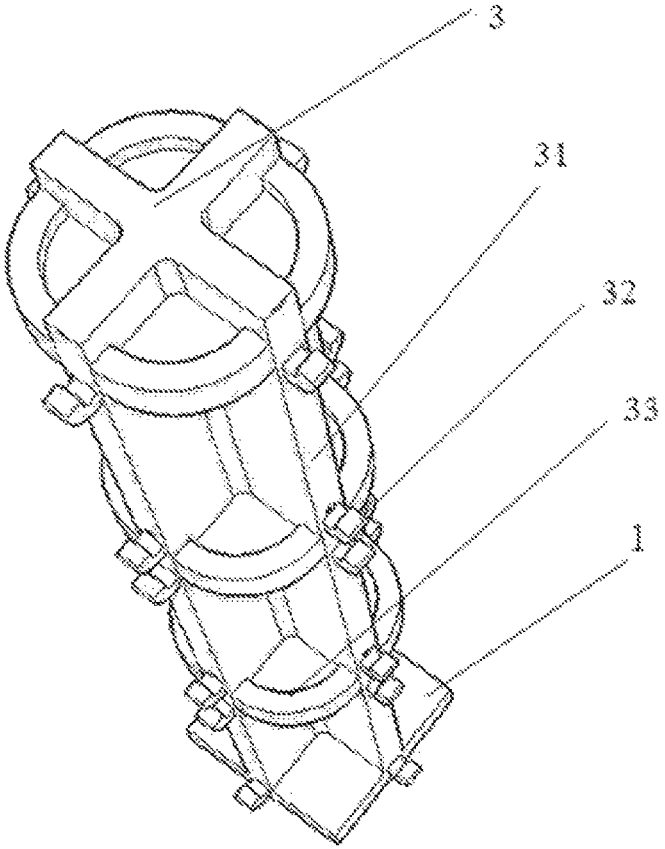
FIG. 4 is a structural schematic diagram of a cross-shaped vertical column of the modular building according to one embodiment of the present disclosure.
Figure 5:
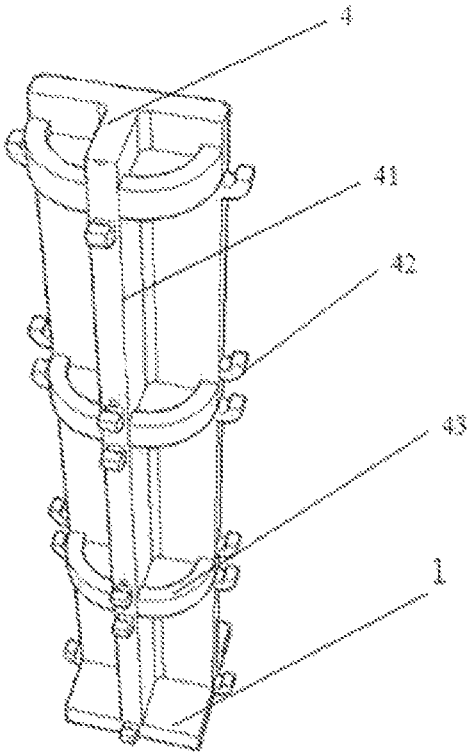
FIG. 5 is a structural schematic diagram of a T-shaped vertical column of the modular building according to one embodiment of the present disclosure.
Figure 6:
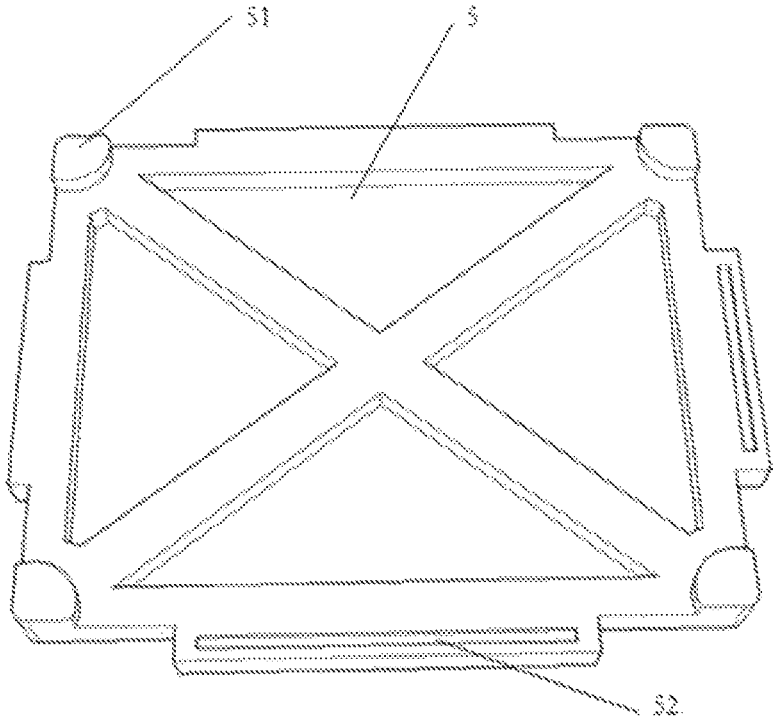
FIG. 6 is a structural schematic diagram of a floor panel of the modular building according to one embodiment of the present disclosure.
Figure 7:
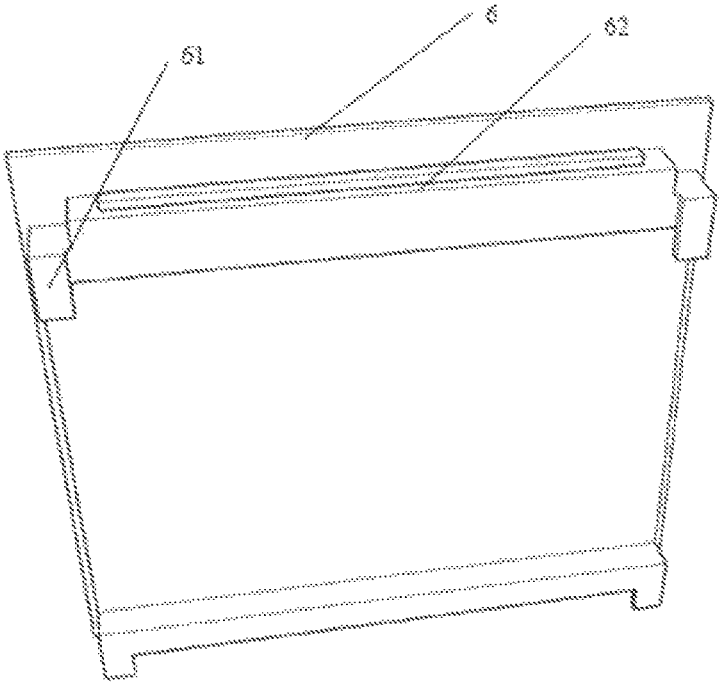
FIG. 7 is a structural schematic diagram of a wall panel of the modular building according to one embodiment of the present disclosure.
Figure 8:
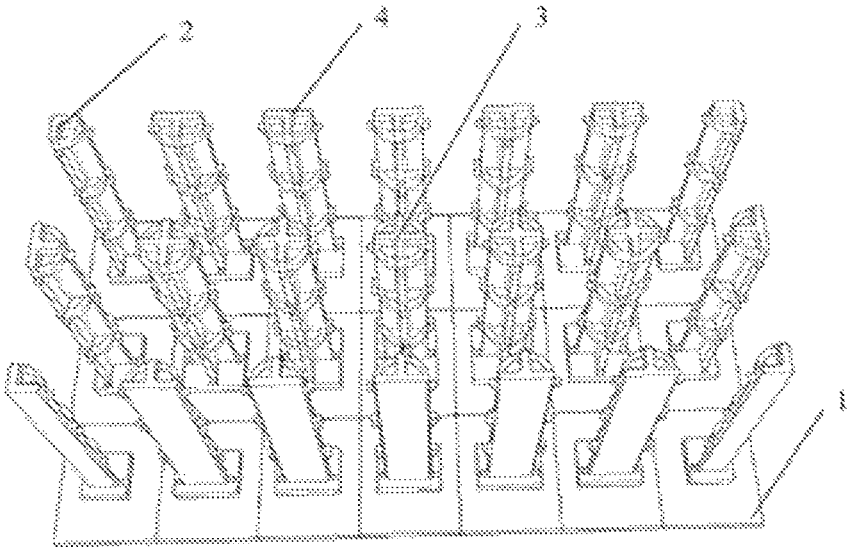
FIG. 8 is a diagram illustrating a use state of the modular building according to one embodiment of the present disclosure.

As shown in FIGS. 1, 2, 3, 4, 5, 6, 7 and 8, the modular building of the present disclosure comprises a wall panel 6, a floor panel 5, a vertical column and a foundation block 1, and a protrusion 11 is provided at a center of a bottom surface of the foundation block 1, when used, the protrusion 11 is inserted into the ground of the building and then cement is poured into gaps at the joints thereof. A recess 12 is provided at a center of a top surface of the foundation block 1, and a protruding post matched with the recess 12 of the foundation block 1 is provided at a bottom part of the vertical column, when used, the protruding post is inserted into the recess 12 of the foundation block 1 and then cement is poured into gaps at joints thereof. And an engagement structure for connecting with the wall panel 6 and the floor panel 5 is provided on the vertical column. The wall panel 6 of the present disclosure can be divided into an outer wall panel and an inner wall panel according to its performance.

The vertical column of the present disclosure is selected from a group consisting of three columns according to a position in the building: the right-angle vertical columns 2 are located at four corners of the periphery of the building, the T-shaped vertical columns 4 are located at the middle part of the periphery of the building, and the cross-shaped vertical columns 3 are located inside the building. A main body of the right-angle vertical column 2 is a right-angle vertical plate 21, and the engagement structure of the right-angle vertical column 2 is as follows: the ends of two right-angle plates of the right-angle vertical plate 21 are provided with a plurality of hanging lugs 22 for connecting with the outer wall plate, and an arc-shaped overlap groove 23 for overlapping with the floor panel 5 is provided between two right-angle plates; similarly, the T-shaped vertical column 4 comprises a plurality of a T-shaped vertical plate 41, and a plurality of hanging lugs 42 for connecting with the outer wall panel are provided at the ends of the two transverse plates of the T-shaped vertical plate 41, and a plurality of hanging lugs 42 for connecting with the inner wall panel are provided at the end of a vertical plate perpendicular to a transverse plate of the T-shaped vertical plate 41, and arc-shaped overlap grooves 43 for overlapping with the floor panel 5 are arranged between the adjacent T-shaped vertical plates 41; likewise, the cross-shaped vertical column 3 comprises a cross-shaped vertical plate 31, and a plurality of hanging lugs 32 for connecting with the inner wall panel are disposed at the ends of four plates of the cross-shaped vertical plate 31, and arc-shaped overlap grooves 33 for overlapping with the floor panel 5 are disposed between adjacent cross-shaped vertical plates 31. The number of hanging lugs and arc-shaped overlap grooves of the vertical columns of the present disclosure coincides with the number of layers of the desired building, that is to say, if planning to build two floors, the right-angle vertical column is made to contain four hanging lugs and two arc-shaped overlap grooves when pouring, and the area size of the floor panel 5 is matched with the area size of the desired building.

The four corners of the wall panel 6 of the present disclosure are provided with the hanging posts 61 matched with the hanging lugs on the vertical columns, and the upper and lower edges of the wall panel 6 are provided with strip-shaped grooves 62 or strip-shaped protrusions for connecting adjacent wall panel 6. And the four corners of the floor panel 5 are provided with arc-shaped protrusions 51 matched with the arc-shaped overlap grooves, and the four edges of the floor panel 5 are provided with strip-shaped grooves 52 or strip-shaped protrusions for connecting adjacent floor panels 5 and connecting with the upper and lower wall panels 6. Cement is poured into gaps at the joints between the vertical columns and the foundation block 1, between the vertical column and the wall panel 6 and between the vertical column and the floor panel 5, which not only increases the stability of the whole building, but also has the features of good weight-bearing, high practicability, safe and reliable operation, energy saving, low cost and rapid assembly.

Certainly, the snap-fitting with buckle and slot can also be used between the components.

The modular building for civil use of the present disclosure is an integrated movable building made from reinforced concrete. The foundation blocks, the wall panels, the floor panels and the vertical columns are prefabricated in a factory with reinforced cement according to the size of the desired building, thereby enabling fast on-site assembly, short construction period, and reduction in the contamination of construction waste and construction dust, and moreover beneficial for the reuse of the materials after the removal or the movement of the building. The present disclosure can provide two ways of building a house, wherein one is "assembly" assembled by the foundation blocks, the vertical columns, the wall panels and the floor panels, and an assembly mode of plug-in and hanging is adopted, and a flexible cushion is lay on the overlap interface, and gaps at the joints are filled with sealant, thereby enabling good anti-shock performance, all components can being detached, reusability within the life of the components, and the damaged components can being replaced after shock; the other is "assembly", of which the size of the components is slightly reduced when the components are manufactured in a factory, and the steel bars of the edge of the components are exposed, and overlap manner is the same with the first "assembly", and cement is poured into gaps at the joints between the steel bars and between the overlap structures after the components are assembled.

Pre-made structural components for constructing the building, such as the wall panel (6), the floor panel (5), the vertical column, and the foundation block (1), are cast in a factory before being shipped to a building site. The structural components are fit together, and then cement is poured into gaps at the joints thereof to complete construction. 90% of the construction work for the building can be completed in a factory, thereby enabling fast on-site assembly, rapid transport, and safe and reliable operation.

The present disclosure may be applied to a modular building for civil use with a small span, which is an integrated movable building made from reinforced concrete. The foundation blocks, the wall panels, the floor panels and the vertical columns are prefabricated in a factory with reinforced cement according to the size of the desired building. The number of hanging lugs and arc-shaped overlap grooves of the vertical columns coincides with the number of layers of the desired building, that is to say, if planning to build two floors, the vertical column is made to contain two hanging lugs in each edge and two arc-shaped overlap grooves when pouring. The area size of the floor panel is matched with the area size of the desired building. Components such as the foundation blocks, the vertical columns, the floor panels, and the wall panels of the present disclosure are integrally cast and formed in one step, and the weight-bearing and connection frame strength thereof are high. The prefabricated components of the building are poured in a factory, and then transferred to a building site, and the components are inserted and connected, and then cement is poured into gaps at the joints thereof to complete construction. In this way, construction of the building is simple and quick, time-saving and work-saving and good stability, and the assembled integral integrated building made from reinforced concrete can be dismounted at any time according to the requirement of the building, and transported to a new place, and remounted together to build a new integrated building made from reinforced concrete. 90% of the construction work for the building can be completed in a factory, thereby enabling fast on-site assembly, rapid transport, and safe and reliable operation.

Although embodiments of the present disclosure have been described in detail, it should be understood that various changes, substitutions and alterations can be made herein without departing from the spirit and scope of the disclosure as defined by the appended claims.

Moreover, the scope of the present disclosure is not intended to be limited to the particular embodiments described here. As one of ordinary skill in the art will readily appreciate from the disclosure of the present disclosure that processes, machines, manufacture, compositions of matter, means, methods, or steps, presently existing or later to be developed, may perform substantially the same function or achieve substantially the same result as the corresponding embodiments described herein. Accordingly, the appended claims are intended to include within their scope such processes, machines, manufacture, compositions of matter, means, methods, or steps.

The invention claimed is:

1. A modular building for civil use, comprising a wall panel, a floor panel and a vertical column, wherein the modular building further comprises a foundation block (1), and a protrusion (11) is provided at a center of a bottom surface of the foundation block (1), and a recess (12) is provided at a center of a top surface of the foundation block (1), and a protruding post matched with the recess (12) of the foundation block (1) is provided at a bottom part of the vertical column, and an engagement structure for connecting with the wall panel (6) and/or the floor panel (5) is provided on vertical column;

wherein the vertical column is selected from a group consisting of a right-angle vertical column (2), a T-shaped vertical column (4) and a cross-shaped vertical column (3);

wherein the wall panel (6) comprises an outer wall panel and an inner wall panel; and wherein when the vertical column is the right-angle vertical column (2), a main body of the right-angle vertical column (2) is a right-angle vertical plate (21), and the engagement structure of the right-angle vertical column (2) is as follows: ends of two right-angle plates of the right-angle vertical plate (21) are provided with a plurality of hanging lugs (22) for connecting with an outer wall panel, and an arc-shaped overlap groove (23) for overlapping with a floor panel (5) is provided between the two right-angle plates of the right-angle vertical plate (21); when the vertical column is the T-shaped vertical column (4), the T-shaped vertical column (4) comprises a T-shaped vertical plate (41), and a plurality of hanging lugs (42) for connecting with the outer wall panel are provided at ends of two transverse plates of the T-shaped vertical plate (41), and a plurality of hanging lugs (42) for connecting with the inner wall panel are provided at an end of a vertical plate perpendicular to one of the two transverse plates of the T-shaped vertical plate (41), and arc-shaped overlap grooves (43) for overlapping with the floor panel (5) are arranged between the T-shaped vertical plates (41); and when the vertical column is the cross-shaped vertical column (3), the cross-shaped vertical column (3) comprises a cross-shaped vertical plate (31), and a plurality of hanging lugs (32) for connecting with the inner wall panel are disposed at ends of four plates of the cross-shaped vertical plate (31), and arc-shaped overlap grooves (33) for overlapping with the floor panel (5) are disposed between adjacent cross-shaped vertical plates (31).

2. The modular building for civil use according to claim 1, wherein four corners of the wall panel (6) are provided with hanging posts (6i) matched with the hanging lugs, and four edges of the wall panel (6) are provided with strip-shaped grooves (62) or strip-shaped protrusions for connecting adjacent wall panels (6), and four corners of the floor panel (5) are provided with arc-shaped protrusions (51) matched with the arc-shaped overlap grooves on the vertical column, and four edges of the floor panel (5) are provided with strip-shaped grooves (52) or strip-shaped protrusions for connecting adjacent floor panels (5).

3. The modular building for civil use according to claim 1, wherein cement is poured into gaps at joints between the vertical column and the wall panel and between the vertical column and the floor panel.

* * * * *